US005203192A

United States Patent [19]

Kimura

[11] Patent Number: 5,203,192

[45] Date of Patent: Apr. 20, 1993

[54] PORTABLE, LIGHTWEIGHT MACHINE FOR BENDING REINFORCING STEEL RODS OR THE LIKE

[75] Inventor: Kiyoshi Kimura, Fujisawa, Japan

[73] Assignee: Kabushiki Kaisha Ogura, Kanagawa, Japan

[21] Appl. No.: 833,671

[22] Filed: Feb. 11, 1992

[30] Foreign Application Priority Data

Feb. 15, 1991 [JP] Japan ..... 3-42790

[51] Int. Cl.[5] ..... B21D 7/02; B21D 9/05

[52] U.S. Cl. ..... 72/217; 72/387; 72/26; 72/219

[58] Field of Search ..... 72/217, 214, 215, 216, 72/218, 219, 387, 319, 318, 316, 26, 459, 444

[56] References Cited

U.S. PATENT DOCUMENTS

| | | | |
|---|---|---|---|
| 1,795,188 | 3/1931 | Wagenbach | 72/388 |
| 2,855,019 | 10/1958 | Engbert | 72/219 |
| 3,393,543 | 7/1968 | Gelder | 72/26 |
| 3,451,236 | 6/1969 | Fowler et al. | 72/26 |
| 3,742,749 | 7/1973 | Bondarenko et al. | 72/219 |
| 4,052,875 | 10/1977 | Sakamoto | 72/387 |
| 4,561,279 | 12/1985 | Wears | 72/217 |

FOREIGN PATENT DOCUMENTS

| | | | |
|---|---|---|---|
| 1221908 | 6/1960 | France | 72/218 |
| 0853768 | 11/1960 | United Kingdom | 72/218 |

*Primary Examiner*—Lowell A. Larson
*Assistant Examiner*—Michael J. McKeon
*Attorney, Agent, or Firm*—Dickstein, Shapiro & Morin

[57] ABSTRACT

A portable bending machine has a boxlike casing with an internal support structure fastened to its top plate only. A reinforcing steel rod is bent around a fulcrum roll by a bending roll revolving about the fulcrum axis, while an adjustable abutment on the top plate of the casing bears against the work. The bending roll, the fulcrum roll, the abutment, and a drive mechanism for revolving the bending roll about the fulcrum roll are all mounted, either directly or via the internal support structure, solely to the top plate of the casing. Consequently, all but the top plate of the casing walls can be made thinner than heretofore.

20 Claims, 6 Drawing Sheets

PORTABLE, LIGHTWEIGHT MACHINE FOR BENDING REINFORCING STEEL RODS OR THE LIKE

BACKGROUND OF THE INVENTION

This invention relates to a machine for bending elongate work such as reinforcing steel rods into a desired angle. More specifically, the invention is directed to improvements in or relating to such a bending machine of the portable class, suitable for transportation from one site of construction to another.

The portable bending machine has been known which has a boxlike casing complete with retractable or foldable handles for the ease of transportation. The top plate of the casing has formed therein an arcuate slot through which an upstanding bending shaft extends with clearance. The bending shaft has a bending roll rotatably mounted on its exposed top end. A fulcrum roll is rotatably mounted on the top of the casing, in a position at which the arcuate slot is centered. Also mounted on the top of the casing is an adjustable abutment for bearing against the work being bent.

A reinforcing steel rod to be bent is to be laid horizontally on the top of the casing, in a position between bending roll and fulcrum roll. The steel rod will be bent by the bending roll around the fulcrum roll as the bending roll travels from one extremity of the arcuate slot toward the other. An electric motor is normally employed in combination with a driving gear train for revolving the bending roll around the fulcrum roll.

A problem has arisen with such a bending machine of conventional make, as the drive motor and the various shafts have so far been mounted, either directly or indirectly, to the top, bottom, and side walls of the casing. One known construction employed a horizontal mounting platform within the casing, with the opposite ends of the platform welded to the side walls of the casing. Some of the shafts were rotatably supported, each at one end, on the platform. Another construction is known in which some rotary shafts were rotatably mounted on the bottom wall of the casing.

The mounting of the various working parts of the bending machine to the side and bottom walls of the casing, in addition to its top plate, is objectionable for several reasons. First, the casing itself had to be of complex construction to permit the mounting of such working parts to its top, bottom and side walls. Second, not only the top but also the bottom and side walls of the casing had to be sufficiently thick and sturdy to firmly hold the working parts in their relative positions, thus adding considerably to the total weight of the machine. Third, difficulties were encountered in mounting some components, notably the drive motor and the associated gear train, within the casing in good working order.

Finally, but not least importantly, elongate shafts were needed according to the conventional mounting methods. Being subject to great bending stresses, such elongate shafts had to be large in diameter, again adding to the total weight of the machine.

SUMMARY OF THE INVENTION

The present invention seeks to overcome all such inconveniences heretofore encountered in the art and aims at the provision of an improved bending machine which is lighter in weight and easier of assemblage.

Briefly, the present invention may be summarized as a machine for bending elongate workpieces such as reinforcing steel rods, comprising fulcrum means mounted to a top plate of a casing, and being means capable of angular displacement about the fulcrum means for bending the workpiece. Abutment means is also mounted to the top plate of the casing for bearing against the workpiece being bent by the bending means about the fulcrum means. Within the casing, drive means for revolving the bending means about the fulcrum means is mounted to a support structure which in turn is mounted solely to the top plate of the casing.

Thus, according to the present invention, the fulcrum means, the bending means, the abutment means and the drive means are all mounted to the top plate of the casing, either directly or via the support structure. The casing can therefore be of simple boxlike construction. Only the top plate of the casing may be made relatively thick and sturdy enough for holding the various working parts of the machine in their correct relative positions. All the side walls and bottom wall of the casing can be made much thinner thereby making the total weight of the bending machine far less than heretofore.

Typically, the drive means comprises an electric motor and a gear train. The bending means is mounted eccentrically to the final gear of the gear train, preferably with a bending means carrier formed substantially in one piece with the final gear by way of reinforcement. In assembling the bending machine, all the drive means as well as parts of the bending means and fulcrum means may first be mounted to the support structure. Then the support structure with the noted parts attached thereto may be introduced into the casing and fastened to its top plate. Thus the bending machine according to the present invention is far easier of assemblage than hitherto.

The above and other features and advantages of the present invention and the manner of realizing them will become more apparent, and the invention itself will best be understood, from a study of the following description and appended claims, with reference had to the attached drawings showing some preferred embodiments of the invention.

DESCRIPTION OF THE PREFERRED EMBODIMENTS

Figure 1:
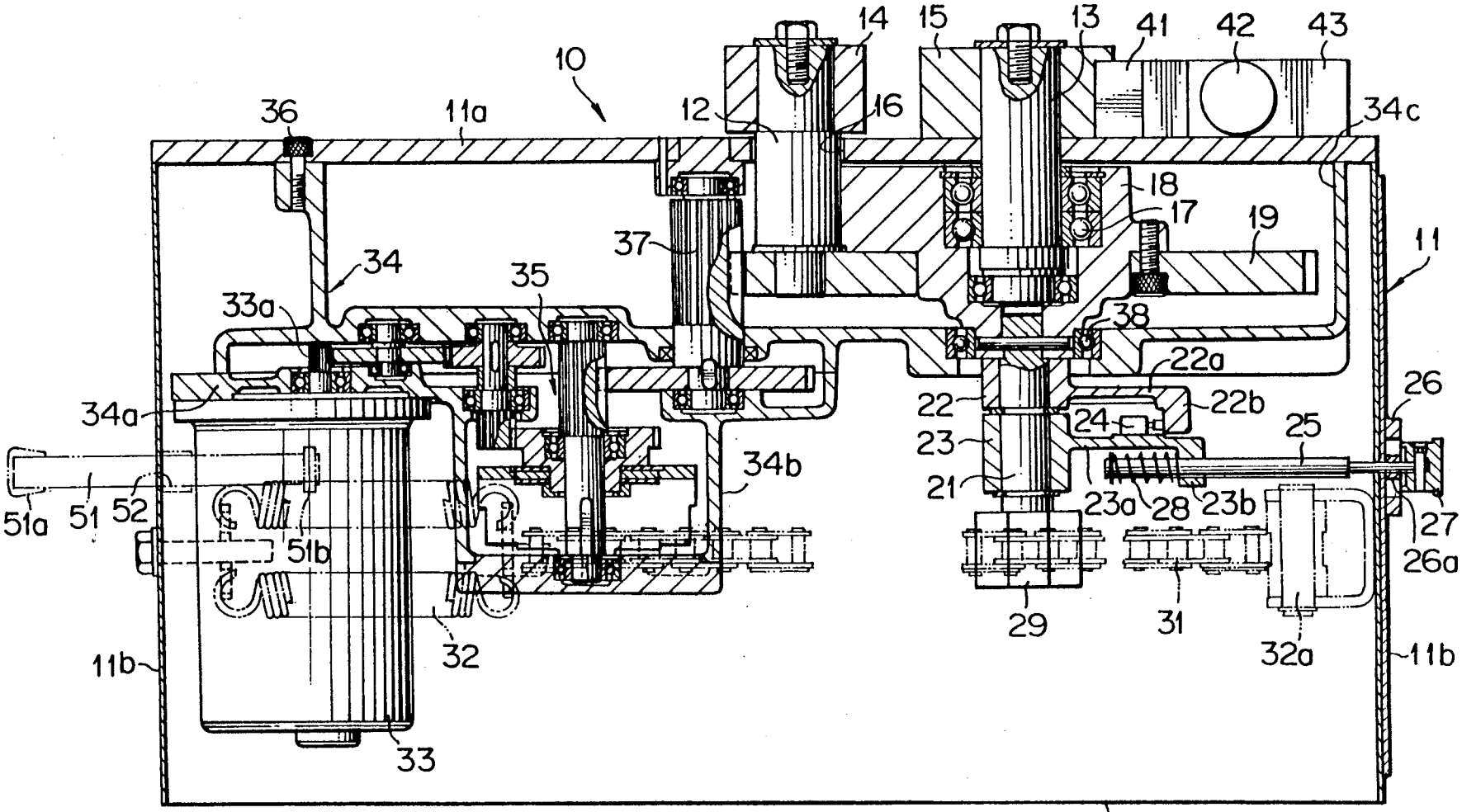
FIG. 1 is a vertical section through the bending machine constructed in accordance with the novel concepts of the present invention.

The bending machine according to the present invention will now be described as adapted for the bending of reinforcing steel rods. Generally designated 10 in FIGS. 1 and 2, the exemplified bending machine has a boxlike casing 11 comprising a top plate 11*a*, four side plates 11*b*, and a bottom plate 11*c*, which are all rigidly interconnected as shown. Only the top plate 11*a* is relatively thick and sturdy whereas the other plates 11*b* and 11*c* of the casing 11 are much thinner and lighter in weight. This thicker top plate of the casing carries practically all the working parts of the bending machine 10, as will become apparent as the description proceeds.

A bending shaft 12 and a fulcrum shaft 13 extend vertically through the top plate 11*a* of the casing 10. A bending roll 14 and a fulcrum roll 15 are rotatably mounted respectively on the exposed top ends of the bending shaft 12 and the fulcrum shaft 13.

Figure 3:
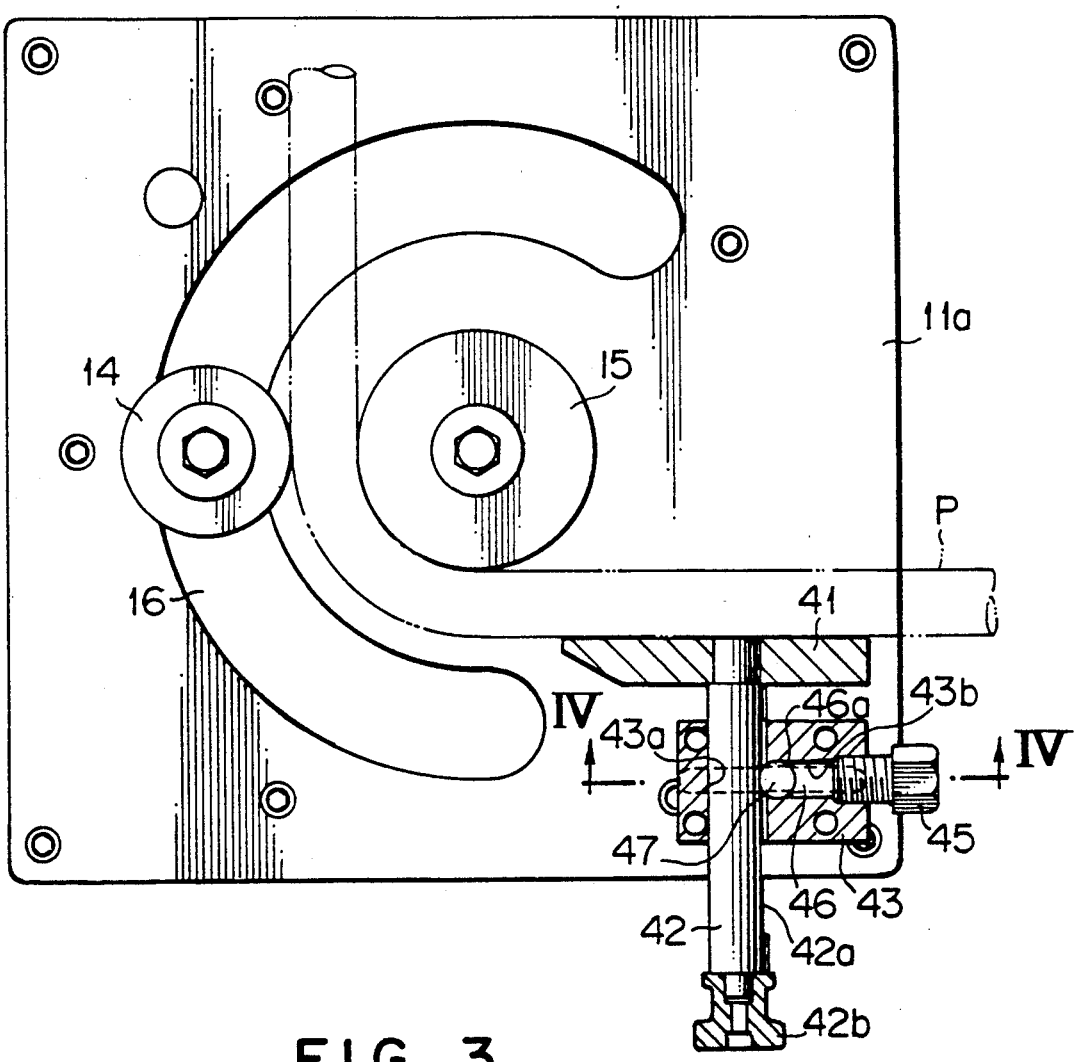
FIG. 3 is a top plan, partly sectioned for clarity, of the bending machine.

As shown also in FIG. 3, the bending shaft 12 extends with clearance through an arcuate slot 16 in the top plate 11*a* of the casing 10. The fulcrum shaft 13 nonrotatably extends through the top plate 11*a*, in a position about which the arcuate slot 16 is centered. A reinforcing steel rod or like elongate work P is bent around the fulcrum roll 15 on the fulcrum shaft 13 as the bending roll 14 on the bending shaft 12 travels along the arcuate slot 16 in rolling engagement with the work P.

As best illustrated in FIG. 1, a bending shaft carrier 18 is rotatably and eccentrically mounted on a lower end portion of the fulcrum shaft 13 via one or more bearings 17. The bending shaft carrier 18 rigidly carries the bending shaft 12. Thus the bending shaft 12 revolves along the arcuate slot 16 with the rotation of the carrier 18 around the fulcrum shaft 13.

For the required revolution of the bending shaft 12 around the fulcrum shaft 13, a driven gear 19 is rotatably and coaxially mounted on the fulcrum shaft. This driven gear is shown firmly coupled to the bending shaft carrier 18 for joint rotation therewith. The bending shaft 12 has a downward extension of reduced diameter embedded in the driven gear 19. The bending shaft carrier 18 and the driven gear 19 are shown as separate parts for the ease of fabrication. Functionally, they could be of one piece construction, so that the bending shaft 12 may be thought of as being mounted directly to the driven gear 19.

Employed for the revolution of the bending shaft 12 around the fulcrum shaft 13 is an electric drive motor 33 within the casing 11. The drive motor 33 is drivingly coupled to the driven gear 19 via a train of gears 35. This gear train includes as a final element a pinion 37 in mesh with the driven gear 19.

The present invention particularly features a unitary support structure 34 disposed within the casing 11 and screwed at 36 solely to its top plate 11*a*. The support structure 34 is formed to include a motor mount 34*a* from which the drive motor 33 is suspended, a gear box 34*b* in which the gear train 35 is housed, and a rotary parts box 34*c* in which there are housed such rotary parts as the bending shaft carrier 18, driven gear 19, bending shaft 12 and fulcrum shaft 13. Also housed in the rotary parts box 34*c* is the noted pinion 37 rotatably supported between the support structure 34 and the top plate 11*a* of the casing 11. FIG. 1 further indicates that the bending shaft carrier 18 has a downward extension extending through a central hole in the driven gear 19 and rotatably journaled in a bearing 38 on the support structure 34.

Thus the support structure 34 makes it possible to mount, either directly or indirectly, all the above recited working parts of the bending machine 10 to only the top plate 11*a* of the casing 11. It is also to be appreciated that the support structure 34 makes materially easier the assemblage of the bending machine 10 than heretofore. To this end the bending shaft 12, fulcrum shaft 13, bending shaft carrier 18, driven gear 19, drive motor 33 and gear train 35 inclusive of the pinion 37 may first be mounted to the support structure 34. Then the support structure with the listed components mounted thereto may be introduced into the casing 11 and screwed to its top plate 11*a*.

As has been stated, the bending shaft 12 revolves around the fulcrum shaft 13 for bending the work P. Since the work may be bent into various angles in use of the bending machine 10, it is desirable that the angle of revolution of the bending shaft 12 be adjustably varied. The following is the description of an example of such angle adjustment means as incorporated in this bending machine.

As illustrated in FIG. 1, a rotary shaft 21 is coaxially coupled to the bending shaft carrier 18 for joint rotation therewith and hence with the driven gear 19. A sleeve 22 is nonrotatably fitted over the rotary shaft 21. An arm 22*a* extends radially from the sleeve 22 and terminates in a depending lug 22*b* which functions as a switch actuator. It will have be seen that the switch actuator 22*b* rotates with the rotary shaft 21 and therefore with the bending shaft 12.

A second sleeve 23 is rotatably fitted over the rotary shaft 21. A switch carrier arm 23*a* extends radially from the second sleeve 23 and terminates in a depending lug 23*b*. A Microswitch (tradename) 24 is mounted on the switch carrier arm 23*a*, in such a position thereon that the switch is to be turned on and off by the switch actuator 22*b*. It is understood that the Microswitch 24 is electrically connected between the drive motor 33 and a power supply, not shown, which may either be built into the bending machine 10 or be external thereto.

Slidably extending through a hole in the depending lug 23*b* of the switch carrier arm 23*a* is a hand lever 25 which further extends with clearance through a slot cut horizontally in one of the side walls 11*b* of the casing 11.

Figure 2:
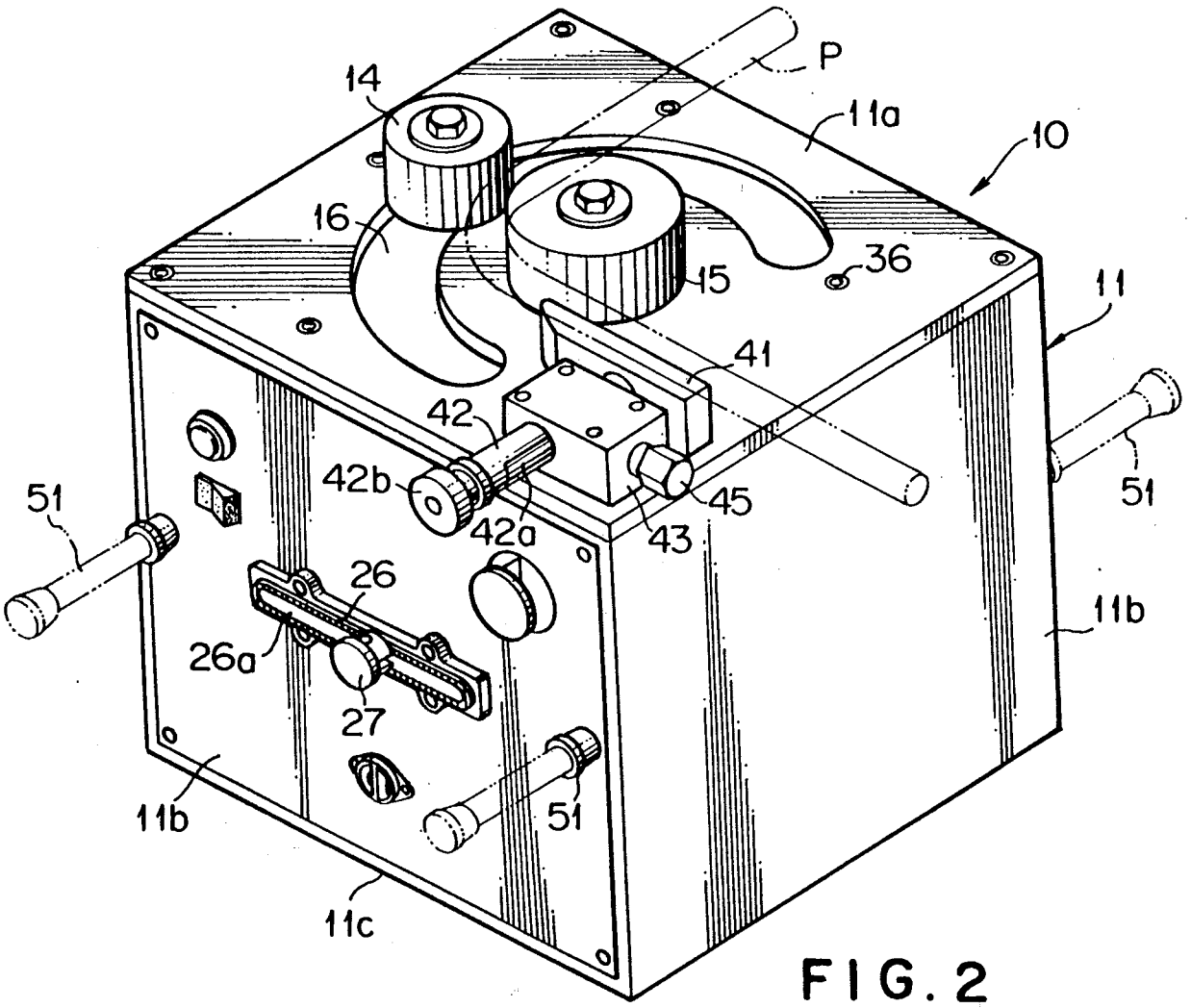
FIG. 2 is a perspective view of the bending machine, shown on a reduced scale.

As shown also in FIG. 2, the hand lever 25 has an enlarged head or knob 27 on its end projecting from within the casing 11. Sleeved upon the hand lever 25, a helical compression spring 28 normally holds the knob 27 against a horizontally elongated scale 26 attached to the casing side wall 11*b*. The scale 26 itself has also a slot 26*a* formed therein to permit the hand lever 25 to extend therethrough with clearance. The scale 26 may be graduated to indicate a series of angular positions of the switch carrier arm 23*a* with respect to the rotary shaft 21, that is, a series of different angles into which work is to be bent. The knob 27 serves as an index or pointer movable along the graduated scale 26.

Thus the angular position of the switch carrier arm 23*a* on the rotary shaft 21 is adjustably variable by pulling the knob 27 away from the casing side wall 11*b* against the force of the compression spring 28 and turning the hand lever 25 about the rotary shaft 21. The knob 27 may be released in a desired position on the graduated scale 26.

The bending machine 10 is further provided with return means for automatically returning the bending shaft 12 to the initial position after bending the work P. As viewed in FIG. 3, the bending roll 14 on the bending shaft 12 revolves clockwise along the arcuate slot 16 for bending the work P. The return means functions to cause the bending roll 14 to revolve counterclockwise along the slot 16 back to one of its extreme positions.

As illustrated in FIG. 1, the return means comprises a takeup roll 29 mounted on the rotary shaft 21 for joint rotation therewith and hence with the bending shaft 12. Elongate flexible means such as a roller chain 31 is anchored at one end to the takeup roll 29. Extending past an intermediate roll 32*a* rotatably mounted to one of the side walls 11*b* of the casing 11, the roller chain 31 has its other end anchored to another casing side wall 11*b* via resilient means herein shown as a parallel arrangement of a pair of helical tension springs 32.

Figure 4:
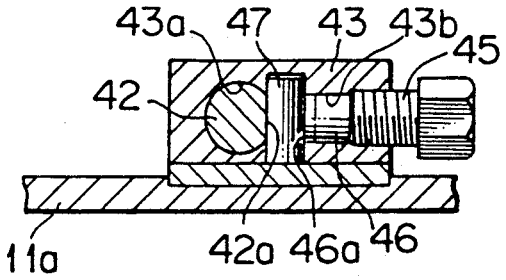
FIG. 4 is a section taken along the line IV—IV in FIG. 3 and showing the adjustable abutment means of the bending machine.

At 41 in FIGS. 1-3 is seen an abutment for bearing against the work P being bent. The abutment 41 is made adjustably movable in a plane parallel to the plane of the casing top plate 11*a* in order to accommodate the bending of reinforcing steel rods of various diameters. Reference may be had primarily to FIGS. 3 and 4 for the following discussion of means for adjustably varying the position of the abutment 41 on the casing top plate 11*a*.

The abutment 41 is immovably supported on one end of a support rod 42 slidably extending through a first hole 43*a* in a fixture 43 on the casing top plate 11*a* and terminating in a grip 42*b* at the other end. The support rod 42 is recessed to provide a flat surface 42*a* extending longitudinally of the support rod. The fixture 43 has formed therein a second hole 43*b* extending at right angles with the first hole 43*a*. The second hole 43*b* is partly tapped for engagement with a threaded member herein shown as a hexagon head, flat end screw 45. The flat end of the screw 45 is held against a thrust member 46 slidably received in the second hole 43*b*. The thrust member 46 has a slanting surface 46*a* which is generally directed toward the first hole 43*a* and which draws nearer the first hole as it extends away from the abutment 41. A wedge member 47 in the form of a short columnar body is disposed between the flat surface 42*a* of the support rod 42 and the slanting surface 46*a* of the thrust member 46.

Thus, when the screw 45 is driven fully into the second hole 43*b*, the wedge member 47 will be frictionally caught between support rod 42 and thrust member 46 thereby preventing the movement of the support rod in a direction away from the abutment 41. The position of the abutment 41 is adjustable by loosening the screw 45.

Preferably, and as shown in both FIGS. 1 and 2, the bending machine 10 may be provided with handle means for ease of transportation. The handle means is herein shown as four retractable handlebars 51, two in horizontally spaced positions on each of the two opposed pair of side walls 11*b* of the casing 11. Each handlebar 51 is slidably received in a hole 52 and has a pair of limit stops 51*a* and 51*b* on its opposite ends thereby to be prevented from disengagement from the hole.

Normally, or when the handlebars 51 are not in use, they may be retracted into the casing 11 so as not to interfere with bending operation. For use, then, the handlebars 51 may be pulled out.

OPERATION

When the drive motor 33 is not energized, the bending roll 14 on the bending shaft 12 will be held in the starting position in the arcuate slot 16 under the force of the return springs 32. A reinforcing steel rod P to be bent may then be laid between bending roll 14 and fulcrum roll 15 on the casing top plate 11*a*, with one end portion of the rod held against the abutment 41.

Before turning the drive motor 33 on, the angle into which the rod P is to be bent may be set by manipulating the knob or pointer 27 on the hand lever 25. To this end the knob 27 may be temporarily pulled away from the graduated scale 26 against the force of the compression spring 28. Then the knob 27 may be moved along the scale 26 thereby turning the hand lever 25, and therefore the switch carrier arm 23*a*, about the rotary shaft 21. Then the knob 27 may be released in a desired position on the scale 26. The Microswitch 24 on the carrier arm 23*a* will then be set in a desired angular position about the rotary shaft 21, that is, the axis of revolution of the bending shaft 12.

Then the drive motor 33 may be switched on. The rotation of the drive motor will be transmitted via the gear train 35 to the driven gear 19, with the consequent rotation of the bending shaft carrier 18 about the fulcrum shaft 13. The bending shaft 12 will then revolve along the arcuate slot 16, so that the rod P will be bent around the fulcrum roll 15 by the bending roll 14, with the abutment 41 bearing against the reactive force of the rod.

During such revolution of the bending shaft 12 the switch actuator 22*b* will rotate with the rotary shaft 21. Then, when the rod P is bent into the preset angle, the switch actuator 22*b* will actuate the Microswitch 24 thereby disconnecting the drive motor 33 from the unshown power supply.

Also, during the revolution of the bending shaft 12, the roller chain 31 has been wound up on the takeup roll 29 rotating with the rotary shaft 21, with the consequent extension of the pair of return springs 32. Therefore, when the drive motor 33 is deenergized as above, the takeup roll 29 will start rotation in the reverse direction by virtue of the energy that has been stored in the return springs 32. Thus the bending shaft 12 will automatically return to the initial position upon deenergization of the drive motor 33.

The position of the abutment 41 may be varied for bending a reinforcing steel rod of a different diameter. To this end the screw 45 on the fixture 43 may first be loosened thereby releasing the wedge member 47 which has been caught frictionally between the flat surface 42*a* of the support rod 42 and the slanting surface 46*a* of the thrust member 46. The support rod 42 has now been unwedged with respect to the fixture 43. Then the support rod 42 with the abutment 41 thereon may be slid in either direction in the hole 43*a* in the fixture 43 by holding the grip 42*b*. Then, with the abutment 41 moved to the required position, the screw 45 may be retightened. Frictionally recaptured between support rod 42 and thrust member 46, the wedge member 47 will firmly maintain the abutment 41 in position against the reactive force of the rod P being bent.

A most pronounced feature of the bending machine 10 is the fact that the bending shaft 12, fulcrum shaft 13, driven gear 19, drive motor 33, gear train 35 inclusive of the pinion 37, and adjustable abutment 41 are all mounted to the top plate 11*a* of the casing 11, either directly or via the support structure 34. Only the casing top plate 11*a* may therefore be made sufficiently thick and sturdy for firmly holding these working parts in their required relative positions. Since the other casing walls can be much thinner, and since the casing itself can be of simple boxlike construction, the bending machine 10 as a whole can be made far lighter in weight than heretofore.

SECOND FORM

Figure 5:
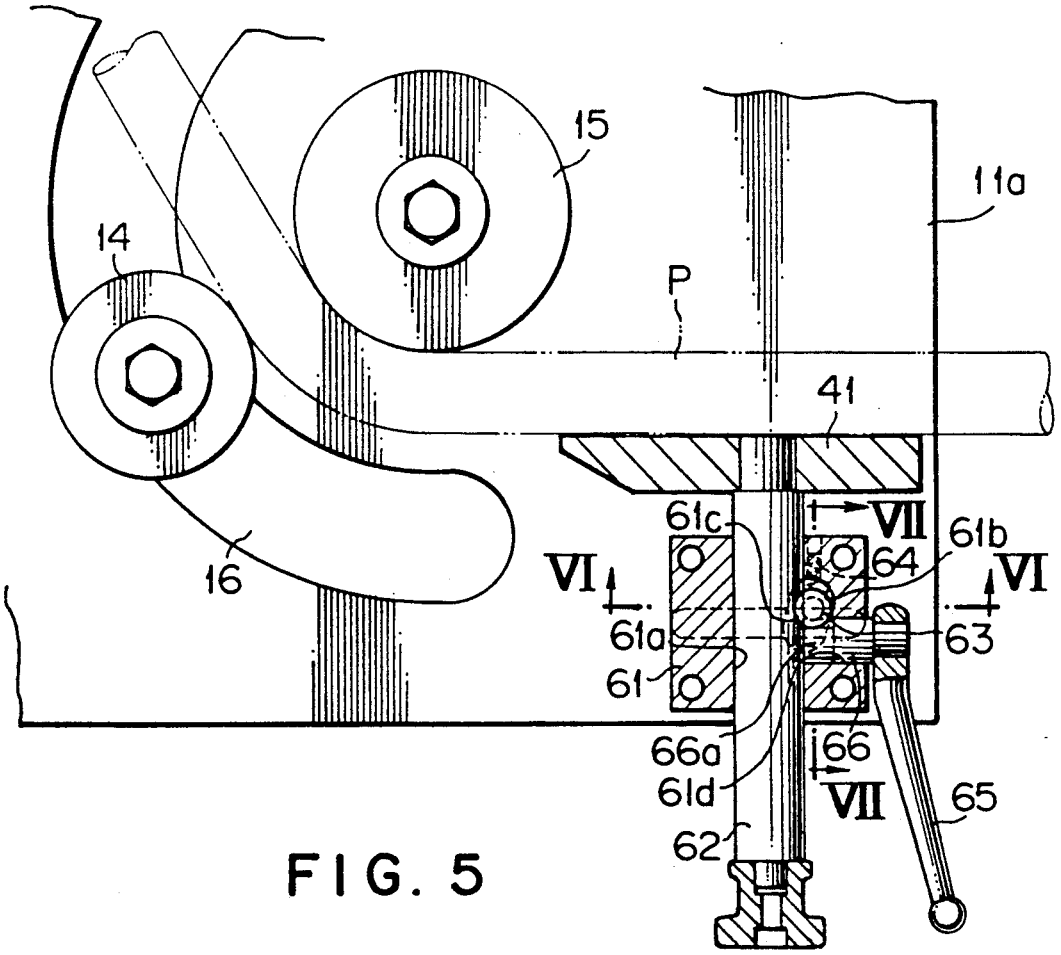
FIG. 5 is a partial top plan including a horizontal section through another preferred form of adjustable abutment means.
Figure 6:
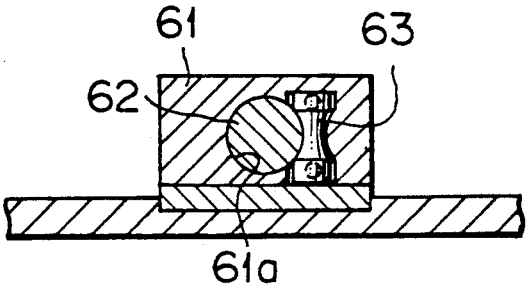
FIG. 6 is a section taken along the line VI—VI in FIG. 5.
Figure 7:
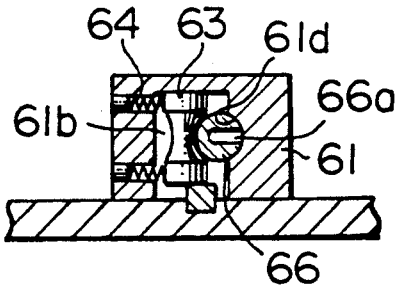
FIG. 7 is a section taken along the line VII—VII in FIG. 5.

FIGS. 5–7 show alternate means for adjusting the position of the abutment 41 to the diameter of the reinforcing steel rod P or like work to be bent. In this alternate embodiment, too, the abutment 41 is attached to one end of a support rod 62 slidably extending through a hole 61*a* in a fixture 61 on the casing top plate 11*a*, as will be noted from FIG. 5. The support rod 62 differs from the support rod 42 of the preceding embodiment in having no recess but being of circular cross section throughout. The fixture 61 has a second hole 61*d* extending at right angles with the first hole 61*a*. Also, at the angle between the two holes 61*a* and 61*d*, there is formed a recess 61*b* having a slanting surface 61*c* which draws nearer the support rod 62 as it extends away from the abutment 41.

As shown also in FIGS. 6 and 7, a wedge member 63 is disposed between the support rod 62 and the slanting surface 61*c* of the recess 61*b*. The wedge member 63 is generally drum shaped, with a concave midportion for frictional contact with the support rod 62. Preferably, and as shown in both FIGS. 5 and 7, a pair of helical compression springs 64 may be provided which acts between fixture 61 and wedge member 63 for urging the latter in a direction to be caught frictionally between support rod 62 and fixture surface 61*c*.

For unwedging the support rod 62 a rod member 66 is rotatably received in part of the second hole 61*d* in the fixture 61, as seen in both FIGS. 5 and 7. The rod member 66 has a prying finger 66*a* formed eccentrically on one end thereof for movement into and out of unwedging engagement with the wedge member 63 with the rotation of the rod member. A hand lever 65 is formed on the other end of the rod member 66 for rotating the same relative to the fixture 61 through an angle of 180 degrees.

OPERATION OF SECOND FORM

The eccentric prying finger 66*a* on the rod member 66 is out of unwedging engagement with the wedge member 63 as depicted in FIG. 7 when the hand lever 65 is held in the position away from the abutment 41 as in FIG. 5. Then the wedge member 63 is frictionally caught between support rod 62 and fixture surface 61*c* under the bias of the compression springs 64. Consequently, by virtue of the wedging action of the wedge member 63, the abutment 41 will positively bear the reactive force of the work P being bent in the manner set forth in connection with FIGS. 1–3.

For varying the position of the abutment 41 the hand lever 65 may be turned 180 degrees from the position of FIG. 5. Thereupon the prying finger 66*a* will come into unwedging engagement with the wedge member 63 thereby releasing the same out of frictional engagement between support rod 62 and fixture surface 61*c* against the force of the compression springs 64. Thus unwedged, the support rod 62 will be free to slide in the first hole 61*a* in the fixture 61, so that the position of the abutment 41 is adjustable to the diameter of the work P to be bent. The hand lever 65 may be turned 180 degrees back to the initial position after the positional adjustment of the abutment 41.

This alternate embodiment offers the advantage that the abutment 41 can be wedged and unwedged simply by turning the hand lever 65 through half a revolution, in contrast to the FIGS. 1–4 embodiment in which the screw 45 has to be turned several revolutions. It will also be appreciated that the frictional engagement of the wedge member 63 between support rod 62 and fixture surface 61*c* is made still more positive and reliable by the springs 64.

THIRD FORM

Figure 8:
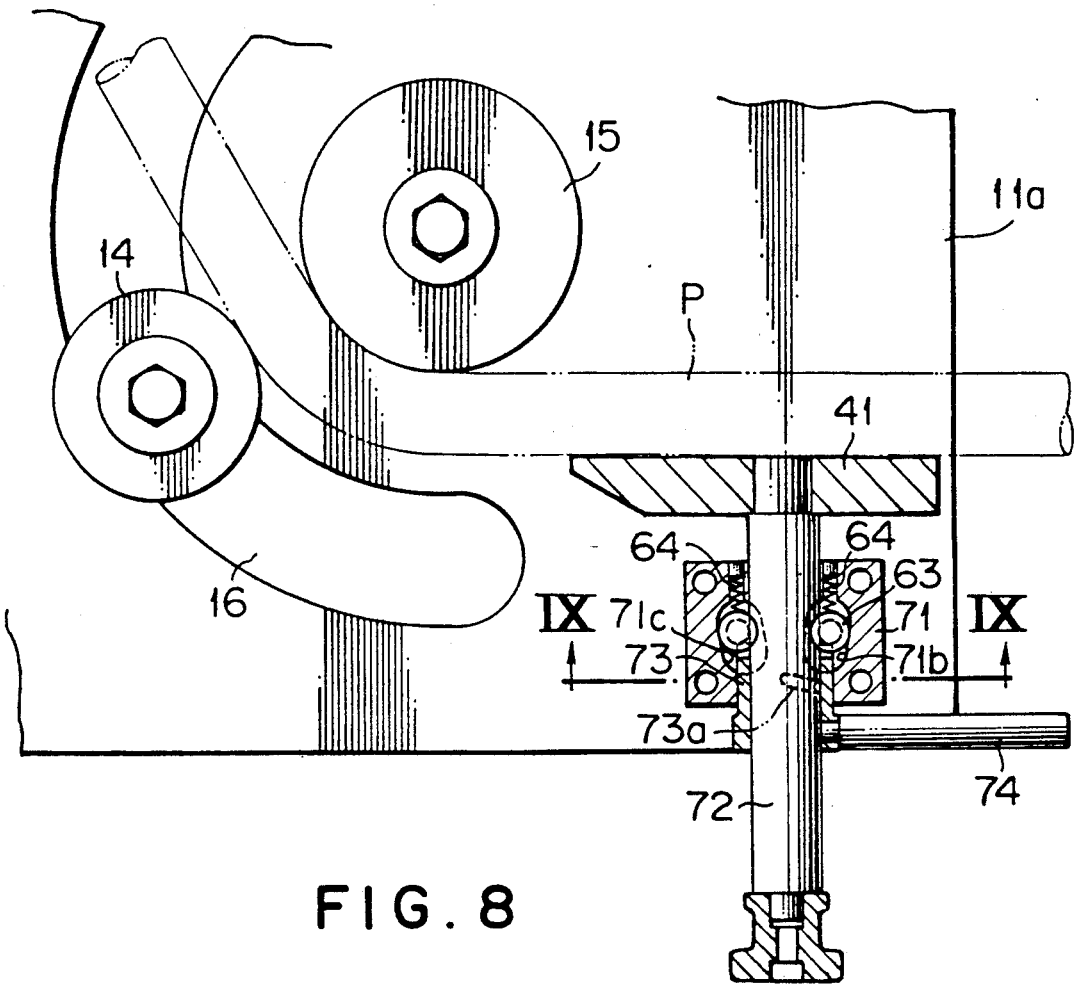
FIG. 8 is a view similar to FIG. 5 but showing still another preferred form of adjustable abutment means.
Figure 9:
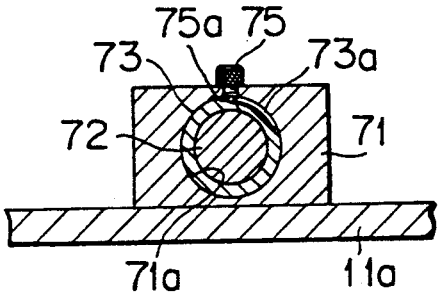
FIG. 9 is a section taken along the line IX—IX in FIG. 8.

FIGS. 8 and 9 show additional alternate means for adjusting the position of the abutment 41 to the diameter of the work P to be bent. In this third embodiment, too, the abutment 41 is attached to one end of a support rod 72 slidably extending through a hole 71*a* in a fixture 71 on the casing top plate 11*a*. The fixture 71 has also formed therein a pair of recesses 71*b* on opposite sides of the hole 71*a*. Each recess 71*b* has a slanting surface 71*c* which draws nearer the support rod 72 as it extends away from the abutment 41.

FIG. 9 shows a pair of wedge members 63 disposed one in each recess 71*b*. Each wedge member is generally drum shaped, with a concave midportion for frictional contact with the support rod 62 of cylindrical shape. A pair of helical compression springs 64 are provided which act each between the fixture 71 and one of the wedge members 63 for urging the latter in a direction to be caught frictionally between support rod 62 and fixture surface 71*c*.

For unwedging the support rod 72 a sleeve 73 is slidably fitted over the support rod and partly slidably received in the hole 71*a* in the fixture 71 for axial movement into and out of unwedging engagement with the pair of wedge members 63. The unwedging sleeve 73 has formed in its outer surface a keyway 73*a* extending at an angle to the circumferential direction of the sleeve. Slidably received in the keyway 73*a* is a key 75 in the form of a screw inserted in a tapped hole 75*a* in the fixture 71. It will therefore be seen that the sleeve 73 linearly travels axially when revolved about its own axis. A hand lever 74 is coupled to the sleeve 73 for causing such revolution of the sleeve 73 relative to the fixture 71 as well as to the support rod 72.

OPERATION OF THIRD FORM

The sleeve 73 on the support rod 72 is out of unwedging engagement with the pair of wedge members 63 when the hand lever 74 is in the horizontal position pictured in FIG. 8. Then the wedge members 63 are frictionally caught between the support rod 72 and the slanting surfaces 71*c* of the recesses 71*b* in the fixture 71 under the forces of the compression springs 64. Therefore, by virtue of the wedging actions of the wedge members 63, the abutment 41 will firmly bear the reactive force of the work P being bent.

For varying the position of the abutment 41 the hand lever 74 may be turned approximately 90 degrees from the horizontal position of FIG. 8 to a vertical position. Thus revolved, the sleeve 73 will travel axially into unwedging engagement with the wedge members 63 as the key 75 on the fixture 71 relatively slides along the keyway 73*a* in the sleeve. The wedge members 63 will then be both released out of frictional engagement between support rod 72 and fixture surfaces 71*c* against the forces of the compression springs 64.

Now unwedged, the support rod 72 will be free to slide in the hole 71*a* in the fixture 71, so that the position of the abutment 41 may be adjusted to the diameter of the work P to be bent. The hand lever 74 may be turned back to the FIG. 8 position after the positional adjustment of the abutment 41.

This second embodiment gains the advantage that the abutment 41 can be wedged and unwedged by turning the hand lever 74 only through a quarter of a revolution. Another advantage is that the pair of wedge members 63 coact to hold the abutment 41 more positively against retraction under the reactive force of the work P being bent, than if only one wedge member is employed as in the foregoing embodiments.

Although the present invention has been shown and described very specifically and as adapted for bending reinforcing steel rods, it is not desired that the invention be limited by the exact details of this disclosure. A variety of modifications, alterations and adaptations of the present invention may be resorted to without departure from the scope of the invention as expressed in the following claims.

What is claimed is:

1. A machine for bending elongate workpieces such as reinforcing steel rods, comprising:

(a) a casing having a top plate;

(b) fulcrum means mounted to the top plate of the casing;

(c) bending means capable of angular displacement about the fulcrum means for bending a workpiece;

(d) abutment means mounted to the top plate of the casing for bearing against the workpiece being bent by the bending means about the fulcrum means, said abutment means comprising:

(1) an abutment;

(2) a fixture immovably mounted to the top plate of the casing, the fixture having a first hole extending therethrough and a second hole extending at right angles with the first hole;

(3) a support rod slidably extending through the first hole in the fixture and carrying the abutment on one end thereof;

(4) a thrust member slidably received in the second hole in the fixture, the thrust member having a slanting surface extending at an angle to the longitudinal direction of the support rod;

(5) a wedge member disposed between the support rod and the slanting surface of the thrust member for preventing the movement of the support rod in a direction from the one to another end thereof by wedging action; and (6) a threaded member threadedly engaged in the second hole in the fixture for pushing the thrust member against the support rod via the wedge member;

(e) a support structure disposed within the casing and mounted solely to the top plate of the casing; and (f) drive means mounted to the support structure for revolving the bending means about the fulcrum means;

(g) whereby all but the top plate of the casing can be of relatively lightweight construction as the fulcrum means, the bending means, the abutment means and the drive means are all mounted, either directly or via the support structure, to the top plate of the casing.

2. A machine for bending elongate workpieces such as reinforcing steel rods, comprising:

(a) a casing having a top plate;

(b) fulcrum means mounted to the top plate of the casing;

(c) bending means capable of angular displacement about the fulcrum means for bending a workpiece;

(d) abutment means mounted to the top plate of the casing for bearing against the workpiece being bent by the bending means about the fulcrum means, said abutment means comprising:

(1) an abutment;

(2) a fixture immovably mounted to the top plate of the casing, the fixture having a first hole extending therethrough, a second hole extending at right angles with the first hole, and a recess at an angle between the first and the second hole, the recess having a slanting surface extending at an angle to the first hole;

(3) a support rod slidably extending through the first hole in the fixture and carrying the abutment on one end thereof;

(4) a wedge member disposed between the support rod and the slanting surface of the recess in the fixture for preventing the movement of the support rod in a direction from the one to another end thereof by wedging action; and (5) unwedging means disposed within the casing and the fixture and acting on the wedge member for unwedging the support rod;

(e) a support structure disposed within the casing and mounted solely to the top plate of the casing;

(f) drive means mounted to the support structure for revolving the bending means about the fulcrum means;

(g) whereby all but the top plate of the casing can be of relatively lightweight construction as the fulcrum means, the bending means, the abutment means and the drive means are all mounted, either directly or via the support structure, to the top plate of the casing.

3. The bending machine of claim 2 wherein the unwedging means comprises:

(a) a rod member rotatably mounted in the second hole in the fixture;

(b) an eccentric prying finger formed on one end of the rod member for movement into and out of unwedging engagement with the wedge member with the rotation of the rod member; and (c) a hand lever formed on another end of the rod member for revolving the same relative to the fixture.

4. The bending machine of claim 2 wherein the abutment means further comprises resilient means acting between the fixture and the wedge member for urging the latter in a direction to be caught frictionally between the support rod and the slanting surface of the recess in the fixture.

5. A machine for bending elongate workpieces such as reinforcing steel rods, comprising:

(a) a casing having a top plate;

(b) fulcrum means mounted to the top plate of the casing;

(c) bending means capable of angular displacement about the fulcrum means for bending a workpiece;

(d) abutment means mounted to the top plate of the casing for bearing against the workpiece being bent by the bending means about the fulcrum means, said abutment means comprising:

(1) an abutment;

(2) a fixture immovably mounted to the top plate of the casing, the fixture having a hole extending therethrough and a pair of recesses on opposite sides of the hole, each recess having a slanting surface extending at an angle to the hole;

(3) a support rod slidably extending through the hole in the fixture and carrying the abutment on one end thereof;

(4) a pair of wedge members disposed respectively between the support rod and the slanting surfaces of the recesses in the fixture for preventing the movement of the support rod in a direction from the one to another end thereof by wedging action; and (5) unwedging means acting on the wedge members for unwedging the support rod;

(e) a support structure disposed within the casing and mounted solely to the top plate of the casing; and (f) drive means mounted to the support structure for revolving the bending means about the fulcrum means;

(g) whereby all but the top plate of the casing can be of relatively lightweight construction as the fulcrum means, the bending means, the abutment means and the drive means are all mounted, either directly or via the support structure, to the top plate of the casing.

6. The bending machine of claim 5 wherein the unwedging means comprises:

(a) a sleeve slidably fitted over the support rod for axial movement into and out of unwedging engagement with the pair of wedge members, the sleeve having formed therein a keyway extending at an angle to the circumferential direction thereof;

(b) a key supported by the fixture and slidably engaged in the keyway in the sleeve; and (c) a hand lever coupled to the sleeve for revolving the same relative to the fixture.

7. The bending machine of claim 5 wherein the abutment means further comprises resilient means acting between the fixture and the pair of wedge members for urging the later in a direction to be caught frictionally between the support rod and the slanting surfaces of the recesses in the fixture.

8. A machine for bending elongate workpieces such as reinforcing steel rods, comprising:

(a) a casing having a top plate;

(b) fulcrum means mounted to the top plate of the casing;

(c) bending means capable of angular displacement about the fulcrum means for bending a workpiece;

(d) abutment means mounted to the top plate of the casing for bearing against the workpiece being bent by the bending means about the fulcrum means;

(e) a support structure disposed within the casing and mounted solely to the top plate of the casing;

(f) drive means mounted to the support structure for revolving the bending means about the fulcrum means;

(g) whereby all but the top plate of the casing can be of relatively lightweight construction as the fulcrum means, the bending means, the abutment means and the drive means are all mounted, either directly or via the support structure, to the top plate of the casing; and (h) angle adjustment means for causing the drive means to revolve the bending means through a predetermined angle, the angle adjustment means comprising:

(1) a rotary shaft capable of joint rotation with the bending means;

(2) a switch carrier rotatably mounted to the rotary shaft;

(3) an electric switch mounted to the switch carrier and electrically connected to the drive means;

(4) a switch actuator mounted to the rotary shaft for joint rotation therewith into and out of engagement with the switch; and (5) means for adjustably varying the angular position of the switch carrier with respect to the rotary shaft, said adjustably varying means comprising a hand lever extending with clearance through a slot in the casing and slidably through a hole in the switch carrier, the hand lever having an enlarged end disposed outside the casing; and resilient means acting between the switch carrier and the hand lever for normally holding the enlarged end of the hand lever in contact with the casing.

9. The bending machine of claim 8 wherein the drive means comprises:

(a) a drive motor;

(b) a driven gear rotatable about the fulcrum means, the driven gear having the bending means mounted eccentrically thereto; and (c) a gear train drivingly connecting the drive motor to the driven gear.

10. The bending machine of claim 9 wherein the bending means comprising:

(a) a bending shaft mounted eccentrically to the driven gear; and (b) a bending roll rotatably mounted to the bending shaft for rolling engagement with the workpiece.

11. The bending machine of claim 9 further comprising a bending means carrier formed substantially in one piece with the driven gear for joint rotation therewith, the bending means carrier carrying the bending means.

12. The bending machine of claim 1 wherein the adjustably varying means of the angle adjustment means further comprises a graduated scale formed on the casing and extending along the slot for indicating the angular position of the switch carrier with respect to the rotary shaft.

13. The bending machine of claim 8 further comprising return means for automatically returning the bending means to an initial position after bending the workpiece, the return means comprising:

(a) a takeup roll capable of joint rotation with the bending means;

(b) resilient means; and (c) elongate flexible means having one end anchored to the takeup roll and another end anchored to the casing via the resilient means.

14. The bending machine of claim 8 wherein the abutment means comprises:

(a) an abutment;

(b) a fixture immovably mounted to the top plate of the casing, the fixture having a first hole extending therethrough and a second hole extending at right angles with the first hole;

(c) a support rod slidably extending through the first hole in the fixture and carrying the abutment on one end thereof;

(d) a thrust member slidably received in the second hole in the fixture, the thrust member having a slanting surface extending at an angle to the longitudinal direction of the support rod;

(e) a wedge member disposed between the support the slanting surface of the thrust member for preventing the movement of the support rod in a direction from the one to another end thereof by wedging action; and (f) a threaded member threadedly engaged in the second hole in the fixture for pushing the thrust member against the support rod via the wedge member.

15. The bending machine of claim 8 wherein the abutment means comprises:

(a) an abutment;

(b) a fixture immovably mounted to the top plate of the casing, the fixture having a first hole extending therethrough, a second hole extending at right angles with the first hole, and a recess at an angle between the first and the second hole, the recess having a slanting surface extending at an angle to the first hole;

(c) a support rod slidably extending through the first hole in the fixture and carrying the abutment on one end thereof;

(d) a wedge member disposed between the support rod and the slanting surface of the recess in the fixture for preventing the movement of the support rod in a direction from the one to another end thereof by wedging action; and (e) unwedging means disposed in the second hole in the fixture and acting on the wedge member for unwedging the support rod.

16. The bending machine of claim 15 wherein the unwedging means comprises:

(a) a rod member rotatably mounted in the second hole in the fixture;

(b) an eccentric prying finger formed on one end engagement with the wedge member with the rotation of the rod member; and (c) a hand lever formed on another end of the rod member for revolving the same relative to the fixture.

17. The bending machine of claim 10 wherein the abutment means further comprises resilient means acting between the fixture and the wedge member for urging the latter in a direction to be caught frictionally between the support rod and the slanting surface of the recess in the fixture.

18. The bending machine of claim 8 wherein the abutment means comprises:

(a) an abutment;

(b) a fixture immovably mounted to the top plate of the casing, the fixture having a hole extending therethrough and a pair of recesses on opposite sides of the hole, each recess having a slanting surface extending at an angle to the hole;

(c) a support rod slidably extending through the hole in the fixture and carrying the abutment on one end thereof;

(d) a pair of wedge members disposed respectively between the support rod and the slanting surfaces of the recesses in the fixture for preventing the movement of the support rod in a direction from the one to another end thereof by wedging action; and (e) unwedging means acting on the wedge members for unwedging the support rod.

19. The bending machine of claim 18 wherein the unwedging means comprises:

(a) a sleeve slidably fitted over the support rod for axial movement into and out of unwedging engagement with the pair of wedge members, the sleeve having formed therein a keyway extending at an angle to the circumferential direction thereof;

(b) a key supported by the fixture and slidably engaged in the keyway in the sleeve; and (c) a hand lever coupled to the sleeve for revolving the same relative to the fixture.

20. The bending machine of claim 18 wherein the abutment means further comprises resilient means acting between the fixture and the pair of wedge members for urging the latter in a direction to be caught frictionally between the support rod and the slanting surfaces of the recesses in the fixture.

* * * * *